US005105969A

United States Patent [19]

Lamas

[11] Patent Number: 5,105,969

[45] Date of Patent: Apr. 21, 1992

[54] DISPOSABLE BOX APPARATUS AND METHOD UTILIZING PLASTIC GROCERY BAGS

[75] Inventor: Leonardo R. Lamas, Tucson, Ariz.

[73] Assignee: Victor Flores, Tucson, Ariz.

[21] Appl. No.: 690,298

[22] Filed: Apr. 24, 1991

[51] Int. Cl.[5] ..... B65D 5/60

[52] U.S. Cl. ..... 220/404; 206/831; 220/403

[58] Field of Search ..... 220/403, 404, 410, 462, 220/463; 206/831

[56] References Cited

U.S. PATENT DOCUMENTS

| | | | |
|---|---|---|---|
| 3,148,820 | 9/1964 | Robbins et al. | 206/831 |
| 3,684,155 | 8/1972 | Smith | 220/404 |
| 4,366,916 | 1/1983 | Guido et al. | 220/404 |
| 4,437,634 | 3/1984 | Hambleton | 220/404 |
| 4,576,310 | 3/1986 | Isgar et al. | 220/404 |
| 4,711,367 | 12/1987 | Albertson | 220/404 |
| 4,856,675 | 8/1989 | Palazzola | 220/404 |
| 4,867,339 | 9/1989 | Hahn | 220/404 |
| 4,892,223 | 1/1990 | Dement | 220/404 |
| 5,018,637 | 5/1991 | Miller | 220/404 |

FOREIGN PATENT DOCUMENTS

| | | | |
|---|---|---|---|
| 100811 | 4/1937 | Australia | 206/831 |
| 2047860 | 4/1971 | Fed. Rep. of Germany | 206/831 |

*Primary Examiner*—Gary E. Elkins
*Attorney, Agent, or Firm*—Victor Flores

[57] ABSTRACT

A container device that facilitates secondary use of plastic grocery bags of the type having a pair of opposed upper integral straps for use as carrying handles. The container includes a pair of opposed supports for receiving the plastic bag's integral straps. Each one of the opposed pair of supports is made up of a hinged flap portion that is provided with slits in alignment with the hinge axis and that effect receiving respective ones of the integral straps. The flap member is provided with a securement member in the form of hook fastening material that can be secured to a mating securement member in the form of loop fastening material located on the outer surface portion of the container. The mated securement members effect positive support of an internally disposed plastic grocery bags. The container's exterior portion further includes promotional incentive items/information for promoting secondary use of said grocery bags including contest games, such as scratch-away portions and claim a prize, colorable characters, posters of celebrities, coupon items, recycle/environmental messages, such as conservation of water, special emergency telephone number listings and other incentive means including advertisements for a business entity that is distributing the container apparatus.

9 Claims, 2 Drawing Sheets

DISPOSABLE BOX APPARATUS AND METHOD UTILIZING PLASTIC GROCERY BAGS

FIELD OF THE INVENTION

This invention relates to cardboard box apparatus. More particularly the present invention relates to cardboard box apparatus having structure that facilitates secondary use of plastic grocery bags.

DESCRIPTION OF THE PRIOR ART

The closest prior art relating to the present invention include wire structure apparatus adapted to receive the integral straps of plastic grocery bags and maintain the hung plastic bag in an opened position for reuse of the plastic grocery bag. Other apparatus for reuse of plastic grocery bags include ordinary cardboard boxes without any particular feature that adequately supports the plastic bag within. Similarly, trash cans have also provided opportunity for reuse of the plastic grocery bags as liners for depositing trash therein. By far the most common reuse of the plastic grocery bag is a stand-alone use as a tote bag or as a trash bag. Present practice among grocers to promote recycle of the plastic grocery bag is to provide a monetary credit to a consumer for bringing their previously used plastic gas to sack their newly purchased groceries.

While the above methods of reusing the plastic grocery bags may exist, the reuse/recycle of the article has not been made attractive to the consumer partly because a secondary vehicle is needed to stimulate the recycle/reuse of the plastic grocery bag. For example, the wire structure apparatus mentioned above does not cover the generally plain exterior design of the bag that generally clashes with a consumer's home decor. The most common problem for non-reuse of the plastic grocery bag is due to the fit problem as a trash bag liner and inability of being supported in the trash can apparatus.

Therefore, a need is seen to exist for a container apparatus that facilitates secondary use of plastic grocery bags.

More particularly, a need is seen to exist for a container apparatus that facilitates secondary use of plastic grocery bags by providing structure that conforms with the carrying integral straps provided on commonly provided grocery bag.

Even more particularly, a need is seen to exist for a container apparatus that facilitates secondary use of plastic grocery bags, that, not only provides structure that conforms with the carrying integral straps provided on commonly provided grocery bag, but that also is adapted with an incentive means for promoting secondary use of said grocery bags, including commercial promotion of a business entity providing the container apparatus.

SUMMARY OF THE INVENTION

Accordingly, the primary object of the present invention is to provide a container apparatus that facilitates secondary use of plastic grocery bags, that provides structure that conforms with the carrying integral straps provided on commonly provided plastic grocery bag, and which container is further adapted with an incentive means for promoting secondary use of said grocery bags, including commercial promotion of a business entity providing the container apparatus.

The foregoing objects are accomplished by providing a container apparatus that facilitates secondary use of plastic grocery bags. The plastic grocery bags are of the type having a pair of opposed upper integral straps for use as carrying handles. The container apparatus of the present invention comprises an inner container portion for receiving the body portion of the plastic grocery bags, a pair of opposed support means for engaging respective ones of the plastic bag's integral straps. Each one of the opposed pair of support means having a hinged strap engagement portion disposed about an upper end of the container apparatus for receiving respective ones of the integral straps. The hinged strap engagement portions includes a flap member having opposed slits in alignment with its hinge axis for detachably receiving and latching respective portions of the integral straps. The flap member is provided with a securement means for securing to an outer surface portion of the container. The securement means effects positive support of the plastic grocery bags.

The container apparatus is also provided with a cover member disposed adjacent to the opposed pair of support means. The cover and a corresponding outer container portion are provided with complementing closure members to aid in containing articles deposited within a plastic grocery bag placed within said container apparatus. The bottom of the container apparatus includes a first and a second bottom flap member oppositely and hingedly disposed about a lower end of a wall defining the inner and outer container portions. As a means of maintaining a stable bottom, the first and second bottom members are provided with complementing pair of straps and strap holders.

In a method of promoting and facilitating reuse of plastic grocery bags, the container of the present invention is provided having the outer container portion and an outer portion of said cover member adapted with an incentive means for promoting secondary use of said grocery bags. The incentive means include the placement of contest games, such as scratch-away portions and claim a prize, colorable characters, posters of celebrities, coupon items, recycle/environmental messages, such as conservation of water, special emergency telephone number listings and other incentive means including advertisements for a business entity that is distributing the container apparatus.

Therefore, to the accomplishments of the foregoing objects, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

DESCRIPTION OF THE PREFERRED EMBODIMENT

Figure 1A:
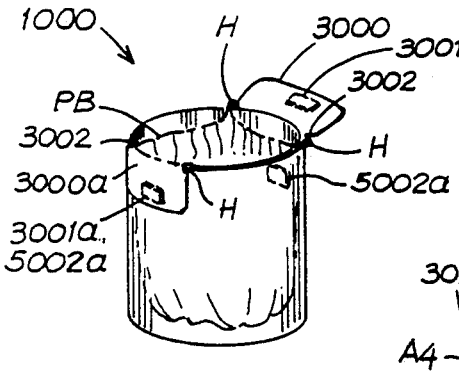
FIG. 1 is a top perspective view of the present invention illustrated as a rectangularly shaped cardboard box having side flap member with structure that conforms to and positively supports integral straps of an internally disposed plastic bag.
Figure 1:
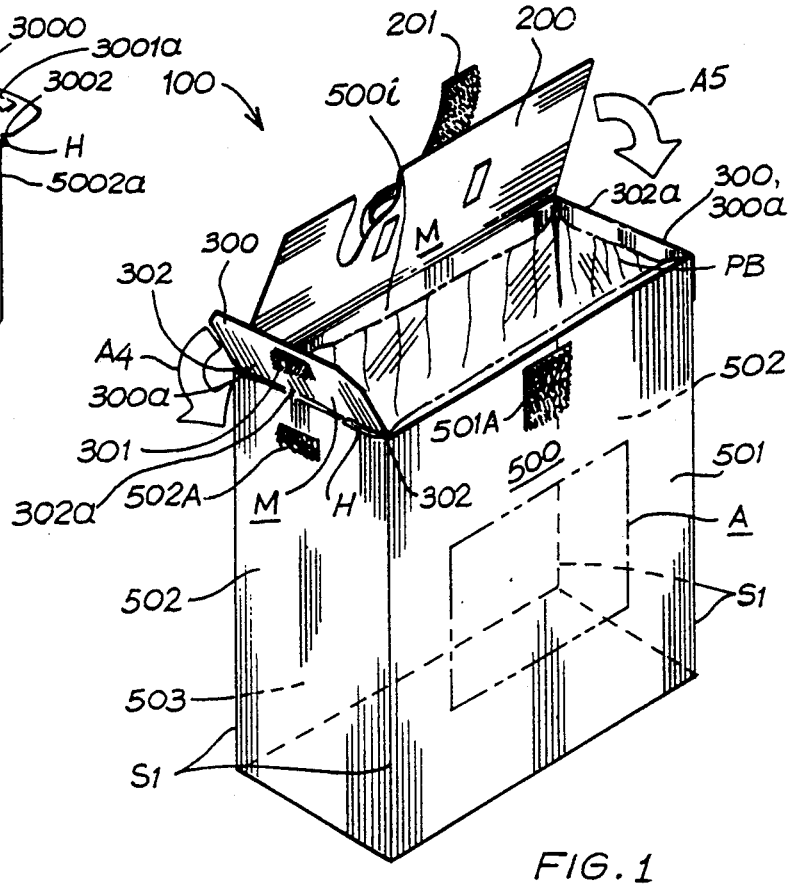
Figure 2:
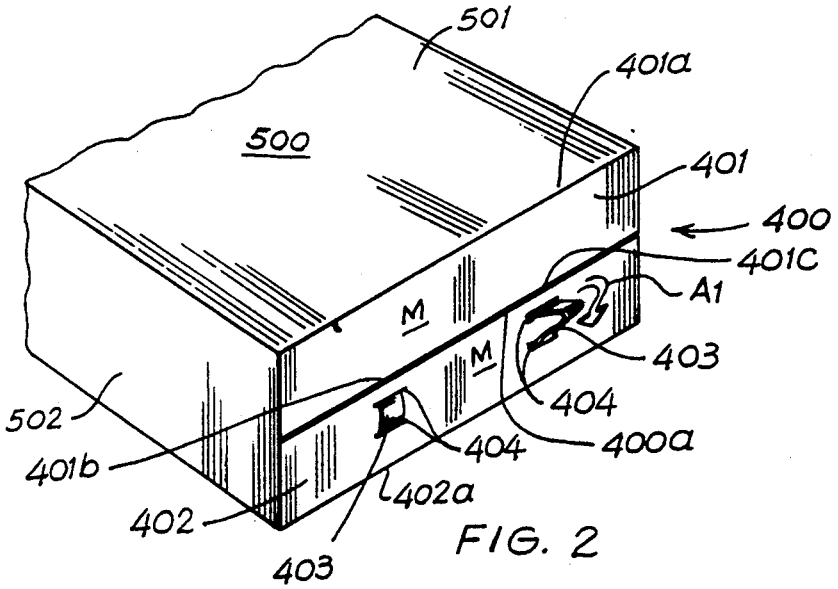
FIG. 2 is a partial perspective view of the bottom of the container apparatus of the present invention illustrating the strap/strap holder arrangement provided on the opposed bottom flap members that maintain the bottom structure in an assembled state.
Figure 3:
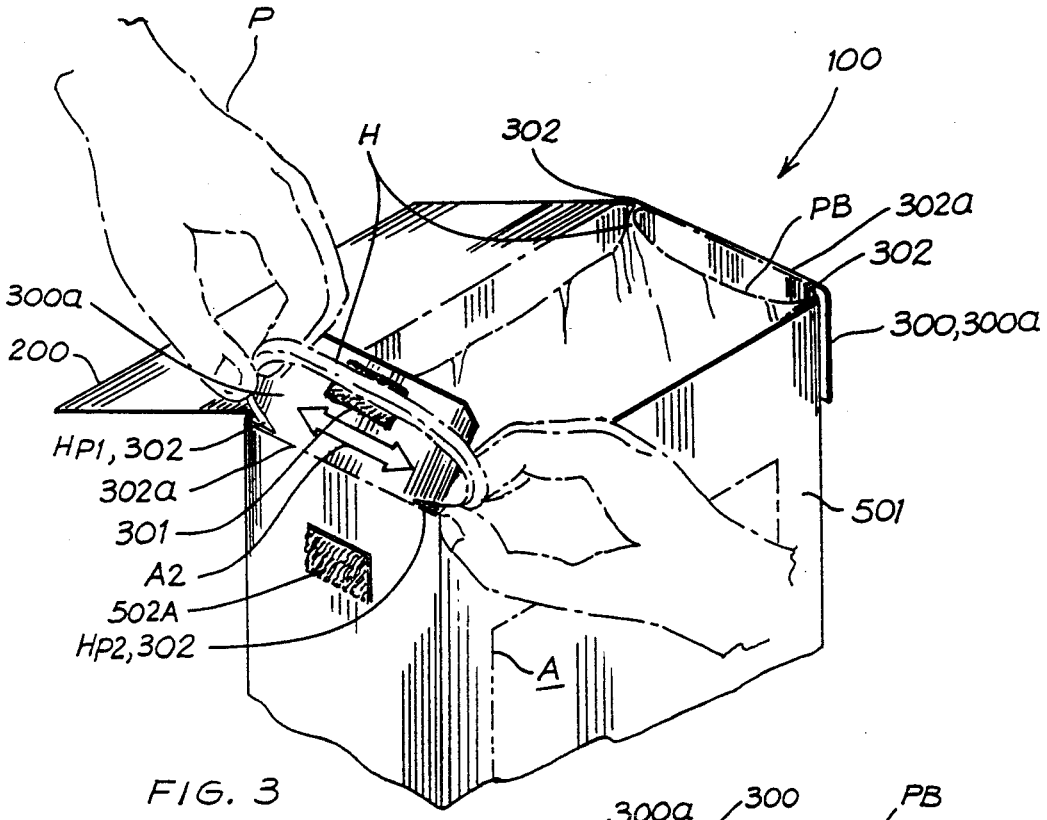
FIG. 3 is a partial perspective view of the top portion of the present invention illustrating the procedure for hanging the integral straps commonly provided on plastic grocery bags, including latching the straps into slits that are in alignment with the hinge axis of the flap member.

Referring now to FIG. 1 where the container apparatus 100 according to the present invention is illustrated. By example, container apparatus 100 is illustrated as a rectangular box, although other shapes, such as cylindrical, can be readily employed. The material used in manufacture of container apparatus 100 is preferably a fibrous, cardboard material, although other suitable material such as plastic, could be utilized. As depicted in FIG. 1, a plastic grocery bag PB is shown disposed within container apparatus, generally referred to as 500*i*. As best seen in FIG. 3, plastic grocery bag PB is comprised of a pair of opposed integral strap portion H, each having handle portions Hp1 and Hp2 that are utilized by the support means 300. Referring also to FIG. 2, container apparatus 100 comprises bottom 400, a container body portion 500, a top cover 200 and a pair of opposed support means 300. Container 100 includes the inner container portion 500*i* for receiving a body portion of a plastic bag PB. It should be noted that other type of bags, other than plastic grocery bags, may be utilized with container apparatus 100, except that if the other type of bags do not have similar handles, support means 300 may not function as intended. Still referring to FIG. 1, the outer container portion of container 100 is adapted for placement of fastening/closure means 501A, 502A and incentive means designated as A. Although not shown, the placement of the incentive A is discretionary and may also be placed on the outer portion of cover 200. As noted earlier incentive A can take many forms, including but not limited to: contest games, such a contest involving a scratch portions and associated prize, colorable characters, posters of celebrities, coupon items, recycle/environmental messages, such as conservation of water message, listing of emergency telephone numbers and other incentive means including advertisement for a business entity that is distributing the container apparatus.

Still referring to FIG. 1, opposing pair of support means 300 are adapted for engaging respective ones of said integral straps H. Each one of the opposed pair of support means 300 includes a flap member 300*a* hinged at 302*a* at an upper end of container apparatus 100 and having opposed slits 302 in alignment with the hinge axis 302*a*. Each flap member 300*a* has attached a securement means 301 for mating, by hinge action indicated by arrow A4, with fastening means 502A provided on a surface portion of the outer container end sides 502 to effect positive support of the plastic grocery bags inserted within. The material used for securement means 301 and fastening means 502A is shown, by example, as hook and loop material, respectively.

Still referring FIG. 1, cover member 200, disposed adjacent to opposed pair of support means 300 and on an upper portion of the side 501, is depicted as having complementing closure members 201 and 501A. The material used for complementing closure members 201 and 502A is shown, by example, as hook and loop material, respectively. Closure of cover 200, as indicated by arrows A5, with the utilization of closure means 201 and 501A, will aid in containing articles deposited within plastic grocery bag PB.

Referring now to FIG. 2, bottom portion 400 includes a first and a second bottom member 401 and 402, oppositely and hingedly disposed at lower ends 401*a* and 402*a*, respectively, of a walls 501 and 503 that partly define container body 500. Bottom members 401 and 402 have respective distal ends that meet at 400*a* to form bottom 400 for container apparatus 100. Bottom member 401 is depicted as having a pair of straps 403 attached at respective distal end locations 401*b* and 401*c* and of sufficient length for in and out insertion, as shown by arrow A1, in corresponding slit strap holders 404 formed on bottom member 402. Straps 403 being detachably secured to respective slit strap holders 404 to maintain said first and second bottom member 401 and 402 in a position that forms bottom 400.

FIG. 1*a* shows an alternative embodiment 1000 in the form of a cylindrically shaped container whereby the support means 300 of embodiment 100 is duplicated in the form of support means 3000 that receive the integral strap H of plastic bag PB. Support means 3000 comprise flap member 3000*a*, slits 3002, and fastening means 3001*a* and 5002A that function in the same manner as flap member 300*a*, slit 302 and fastening means 301 and 502A, describe previously.

Container apparatus 100 is preferably provided to the consumer in an unassembled, flattened form (not shown). Container 100 includes scribed S1 that delineate formation of walls 501, 502 and 503 and appropriate markings M that identify support means 300, cover member 200 and first and second bottom members 401 and 402. The consumer can readily assemble the apparatus by following a sequence indicated by markings M.

Figure 4:
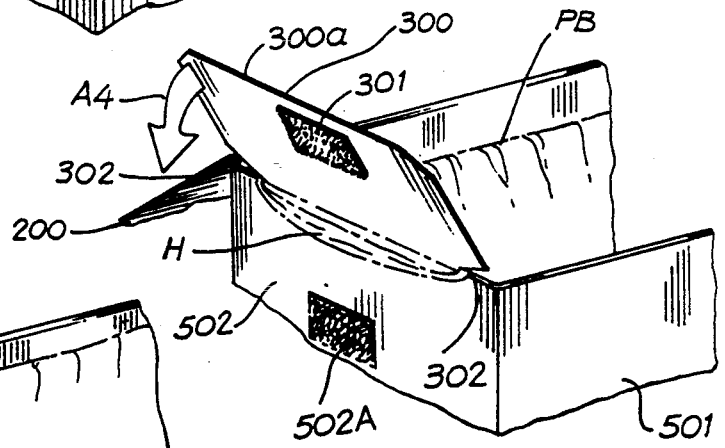
FIG. 4 is a partial perspective view of the top portion of the present invention illustrating the hook and loop securement of the flap member to a mating fastening member provided on the outer portion of the container.
Figure 5:
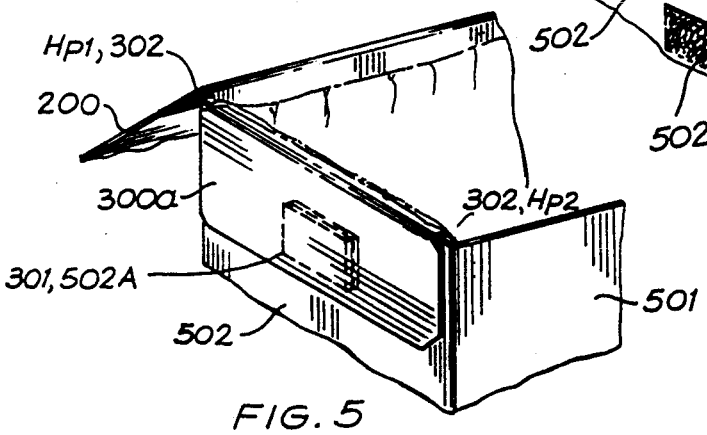
FIG. 5 is a partial perspective view of an upper portion of the present invention illustrating the flap member in a secured position and the plastic grocery bag firmly supported within.

In operation, container apparatus 100 is provided with a predetermined incentive means A of the type discussed previously for promoting secondary use of said plastic grocery bags. As shown in FIG. 3, a person P is shown securing the plastic bag strap H to flap member 300*a*. In particular, person P is shown latching the strip portions Hp1 and Hp2 into slits 302 as indicated by arrow A2. FIG. 4 shows the motion arrow A4 by which flap member 300*a* will be secured to side 502 upon attachment of securement means 301 to closure means 502A. At this point plastic bag straps H have been latched into slits 302. FIG. 5 shows the secured state of flap member 300*a* whereby securement means 301 is shown mated to closure means 502A and plastic bag portions Hp1 and Hp2 are firmly secured beneath flap member 300*a*.

Therefore, while the present invention has been shown and described herein in what is believed to be the most practical and preferred embodiments, it is recognized that departures can be made therefrom within the scope of the invention, which is therefore not to be limited to the details disclosed therein but is to be accorded the full scope of the claims so as to embrace any and all equivalent apparatus.

I claim:

1. A container apparatus for facilitating secondary use of plastic grocery bags, said grocery bags having a pair of oppsed upper integral straps for use as carrying handles, said container apparatus comprising:

an inner container portion for receiving a body portion of one of said plastic grocery bags;

an outer container portion, said outer container portion having an incentive means disposed on said outer container portion for promoting secondary use of said plastic grocery bags and promotion of a business entity providing said container apparatus;

a pair of opposed support means for engaging respective ones of said integral straps, each one of said opposed pair of support means comprising a hinged strap engagement portion disposed about an upper end of said container apparatus for receiving said integral straps and a securement means for securing said hinged strap engagement portion to a surface portion of said outer container portion to effect positive support of said one of said plastic grocery bags;

a cover member disposed adjacent to said opposed pair of support means, said cover and said container portion having complementing closure members to aid in containing articles deposited within said plastic grocery bag placed within said container apparatus; and a first and a second bottom member oppositely and hingedly disposed about a lower end of a wall defining said inner and outer container portions, said first and second bottom members having respective distal ends that meet to form a bottom for said container apparatus.

2. A container apparatus for facilitating secondary use of plastic grocery bags as recited in claim 1, wherein:

said securement means and said complementing closure members comprise hook and loop fastening material.

3. A container apparatus for facilitating secondary use of plastic grocery bags as recited in claim 2, wherein:

said container apparatus comprises a rectangularly shaped cardboard box, said box being formed to include scribed box members that delineate formation of said wall forming said outer and inner container portions, said support means, said cover member, and said first and second bottom members, said first bottom member having a pair of straps attached at a respective distal end, and said second bottom member having a pair of strap holders formed at its respective distal end, said pair of straps being detachably secured to respective strap holders to maintain said first and second bottom member in a meeting position to form said bottom; and each of said hinged strap engagement portions comprising a flap member having opposed slits in alignment with a hinge axis of saic flap member for detachably receiving and securing respective portions of said plastic grocery bag's integral straps.

4. A container apparatus for facilitating secondary use of plastic grocery bags as recited in claim 1, wherein:

said container apparatus comprises a cylindrically shaped cardboard box, said box being formed to include scribed box members that delineate formation of said wall forming said outer and inner container portions, said support means, said cover member, and said first and second bottom members, said first bottom member having a pair of straps attached at a respective distal end, and said second bottom member having a pair of strap holders formed at its respective distal end, said pair of straps being detachably secured to respective strap holders to maintain said first and second bottom member in a meeting position to form said bottom; and each of said hinged strap engagement portions comprising a flap member having opposed slits in alignment with a hinge axis of said flap member for detachably receiving and securing respective portions of said plastic grocery bag's integral straps.

5. A container apparatus for facilitating secondary use of plastic grocery bags, said grocery bags having a pair of opposed upper integral straps for use as carrying handles, said container apparatus comprising:

an inner container portion for receiving a body portion of one of said plastic grocery bags;

an outer container portion;

a pair of opposed support means for engaging respective ones of said integral straps, each one of said opposed pair of support means comprising a hinged strap engagement portion disposed about an upper end of said container apparatus for receiving said integral straps and a securement means for securing said hinged strap engagement portion to a surface portion of said outer container portion to effect positive support of said one of said plastic grocery bags;

a cover member disposed adjacent to said opposed pair of support means, said cover and said outer container portion having complementing closure members to aid in containing articles deposited within said plastic grocery bag placed within said container apparatus; and a first and a second bottom member oppositely and hingedly disposed about a lower end of a wall defining said inner and outer container portions, said first and second bottom members having respective distal ends that meet to form a bottom for said container apparatus, said first bottom member having a pair of straps attached at a respective distal end, and said second bottom member having a pair of strap holders formed at its respective distal end, said pair of straps being detachably secured to respective strap holders to maintain said first and second bottom member in a meeting position to form said bottom.

6. A container apparatus for facilitating secondary use of plastic grocery bags as recited in claim 5, wherein:

said container apparatus comprises a rectangularly shaped cardboard box, said box being formed to include scribed box members that delineate formation of said wall forming said outer and inner container portions, said support means, said cover member, and said first and second bottom members, each of said hinged strap engagement portions comprising a flap member having opposed slits in alignment with a hinge axis of said flap member for detachably receiving and securing respective portions of said straps, said outer container portion and an outer portion of said cover member having an incentive means disposed on said outer container portion and said outer portion of said cover member for promoting secondary use of said grocery bags and promotion of a business entity providing said container apparatus, and said securement means and said complementing closure members comprise hook and loop fastening material.

7. A container apparatus for facilitating secondary use of plastic grocery bags as recited in claim 5, wherein:

said container apparatus comprises a cylindrically shaped cardboard box, said box being formed to include scribed box members that delineate formation of said wall forming said outer and inner container portions, said support means, said cover member, and said first and second bottom members, each of said hinged strap engagement portions comprising a flap member having opposed slits in alignment with a hinge axis of said flap member for detachably receiving and securing respective portions of said straps, said outer container portion and an outer portion of said cover member having an incentive means disposed on said outer container portion and said outer portion of said cover member for promoting secondary use of said grocery bags and promotion of a business entity providing said container apparatus, and said securement means and said complementing closure members comprise hook and loop fastening material.

8. A method of promoting and facilititating reuse of plastic grocery bags, said grocery bags having a pair of opposed upper integral straps for use as carrying handles, said method comprising the steps of:

(a) providing a container apparatus, said container apparatus comprising:

an inner container portion for receiving a body portion of one of said plastic grocery bags;

an outer container portion;

a pair of opposed support means for engaging respective ones of said integral straps, each one of said opposed pair of support means comprising a hinged strap engagement portion disposed about an upper end of said container apparatus for receiving said integral straps and a securement means for securing said hinged strap engagement portion to a surface portion of said outer container portion to effect positive support of said one of said plastic grocery bags;

(b) providing said plastic grocery bags for reuse;

(c) assembling said provided container apparatus;

(d) inserting a one of said provided plastic grocery bags into said assembled container;

(e) supporting said one plastic grocery bag by hanging each integral strap of said pair of integral straps on a corresponding one of said hinged strap engagement portion and latching each said integral strap to respective ones of said hinged strap engagement portion provided on each said support means; and (f) securing said one plastic grocery bag in said container by detachably fastening said hinged strap engagement portion to said container outer portion using said securement means.

9. A method of promoting and facilitating reuse of plastic grocery bags as recited in claim 8, wherein:

said step of providing said container apparatus further comprises providing a container apparatus comprising:

a cover member disposed adjacent to said opposed pair of support means, said cover and said outer container portion having complementing closure members to aid in containing articles deposited within said plastic grocery bag placed within said container apparatus;

a first and a second bottom member oppositely and hingedly disposed about a lower end of a wall defining said inner and outer container portions, said first and second bottom members having respective distal ends that meet to form a bottom for said container apparatus, said first bottom member having a pair of straps attached at a respective distal end, and said second bottom member having a pair of strap holders formed at its respective distal end, said pair of straps being detachably secured to respective strap holders to maintain said first and second bottom member in a meeting position to form said bottom; and said method further comprises the step of:

disposing an incentive means on said outer container portion and an outer portion of said cover member for promoting secondary use of said plastic grocery bags as well as promotion of a business entity providing said container apparatus.

* * * * *